US011798732B2

(12) United States Patent
Igarashi et al.

(10) Patent No.: US 11,798,732 B2
(45) Date of Patent: Oct. 24, 2023

(54) COIL COMPONENT MANUFACTURING METHOD

(71) Applicant: Murata Manufacturing Co., Ltd., Kyoto-fu (JP)

(72) Inventors: Akio Igarashi, Nagaokakyo (JP); Kentaro Yamaguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 186 days.

(21) Appl. No.: 17/322,752

(22) Filed: May 17, 2021

(65) Prior Publication Data

US 2021/0272742 A1 Sep. 2, 2021

Related U.S. Application Data

(62) Division of application No. 16/006,508, filed on Jun. 12, 2018, now Pat. No. 11,062,838.

(30) Foreign Application Priority Data

Jun. 24, 2017 (JP) ..... 2017-123774

(51) Int. Cl.
*H01F 27/29* (2006.01)
*H01F 41/10* (2006.01)
(Continued)

(52) U.S. Cl.
CPC ..... *H01F 27/29* (2013.01); *H01F 17/04* (2013.01); *H01F 27/24* (2013.01);
(Continued)

(58) Field of Classification Search
CPC ..... H01F 17/04; H01F 27/24; H01F 27/2823; H01F 27/2828; H01F 27/29; H01F 27/292; H01F 41/10
See application file for complete search history.

(56) References Cited

U.S. PATENT DOCUMENTS 3,585,553 A 6/1971 Muckelroy et al.
4,926,151 A 5/1990 Morinaga
(Continued)

FOREIGN PATENT DOCUMENTS

JP 2007-103596 A 4/2007
JP 2009-147159 A 7/2009
(Continued)

OTHER PUBLICATIONS

An Office Action; "Notification of Reasons for Refusal," Mailed by the Japanese Patent Office dated Sep. 3, 2019, which corresponds to Japanese Patent Application No. 2017-123774 and is related to U.S. Appl. No. 16/006,508; with English language translation.
(Continued)

*Primary Examiner* — Minh N Trinh
(74) *Attorney, Agent, or Firm* — Studebaker & Brackett PC

(57) ABSTRACT

A method for manufacturing a coil component includes preparing a wire; preparing a terminal electrode formed from a metal plate having a flat surface to which an end portion of the wire is to be connected, a low surface that is lower in a thickness direction of the terminal electrode than the flat surface, and a shift surface that connects the flat surface to the low surface and that increases a height in the thickness direction from the low surface to the flat surface; placing the end portion of the wire on the flat surface such that the wire is provided sequentially along the flat surface, the shift surface, and the low surface in this order from the end portion thereof; and thermally pressure-bonding the end portion of the wire to the flat surface such that the heated chip is pressed so that an edge thereof overlaps the low surface.

9 Claims, 7 Drawing Sheets

(51) Int. Cl.
*H01F 27/24* (2006.01)
*H01F 27/28* (2006.01)
*H01F 17/04* (2006.01)

(52) U.S. Cl.
CPC ..... *H01F 27/2823* (2013.01); *H01F 27/2828* (2013.01); *H01F 27/292* (2013.01); *H01F 41/10* (2013.01)

(56) References Cited

U.S. PATENT DOCUMENTS

| | | | | |
|---|---|---|---|---|
| 5,357,226 | A | 10/1994 | Azuma | |
| 6,472,969 | B1 | 10/2002 | Hanato | |
| 11,062,838 | B2 * | 7/2021 | Igarashi | H01F 27/292 |
| 2002/0190832 | A1 | 12/2002 | Amada et al. | |
| 2003/0141952 | A1 | 7/2003 | Moro et al. | |
| 2004/0263285 | A1 | 12/2004 | Suzuki et al. | |
| 2005/0237141 | A1 | 10/2005 | Hirai et al. | |
| 2009/0273426 | A1 | 11/2009 | Urabe et al. | |
| 2011/0128107 | A1 | 6/2011 | Kitagawa et al. | |
| 2016/0133377 | A1 | 5/2016 | Takagi et al. | |
| 2016/0172093 | A1 | 6/2016 | Fan et al. | |
| 2016/0351323 | A1 | 12/2016 | Wakamori et al. | |
| 2017/0140858 | A1 | 5/2017 | Takagi et al. | |
| 2021/0272742 | A1 * | 9/2021 | Igarashi | H01F 27/2828 |

FOREIGN PATENT DOCUMENTS

| | | | |
|---|---|---|---|
| JP | 2011-119379 | A | 6/2011 |
| JP | 2015-050373 | A | 3/2015 |
| JP | 2017-092349 | A | 5/2017 |

OTHER PUBLICATIONS

An Office Action mailed by the German Patent Office dated May 15, 2019 which corresponds to German Patent Application No. 10 2018 209 534.5 and is related to U.S. Appl. No. 16/006,508 with English language translation.

* cited by examiner

COIL COMPONENT MANUFACTURING METHOD

CROSS-REFERENCE TO RELATED APPLICATION

This application is a Divisional of U.S. patent application Ser. No. 16/006,508, filed on Jun. 12, 2018, now U.S. Pat. No. 11,062,838, which claims benefit of priority to Japanese Patent Application No. 2017-123774, filed Jun. 24, 2017, the entire content of which is incorporated herein by reference.

BACKGROUND

Technical Field

The present disclosure relates to a coil component and a manufacturing method therefor.

Background Art

Japanese Unexamined Patent Application Publication No. 2015-50373 discloses a coil component having a structure in which a wire and terminal electrode are connected to each other by thermally pressure-bonding. FIG. 10 illustrates a thermally pressure-bonding, wherein a part of a substantially drum-shaped core 72 included in a coil component 71 is shown.

The drum-shaped core 72 has a winding core portion 74 having a wire 73 helically wound therearound. In addition, first and second end portions of the winding core portion 74 that are opposite to each other are provided with first and second flange portions, respectively, but only one flange portion 75 is shown in FIG. 10. A terminal electrode 76 formed from a metal plate extending in an L shape is mounted on the flange portion 75. An end portion of the wire 73 extended from the winding core portion 74 is connected to the terminal electrode 76.

Thermally pressure-bonding by pressing a heated chip 77 is used for the above-described connection of the wire 73 to the terminal electrode 76. As shown in FIG. 10, the heated chip 77 is placed so as to oppose the terminal electrode 76 with the wire 73 interposed therebetween. In this state, the heated chip 77 is pressed toward the terminal electrode 76. As a result, the end portion of the wire 73 is thermally pressure-bonded to the terminal electrode 76.

SUMMARY

In the above-described thermally pressure-bonding, at a portion interposed between the heated chip 77 and the terminal electrode 76, the wire 73 is flattened in the thermally pressure-bonding direction by pressure applied from the heated chip 77, and at a portion at which an edge 76*a* of the terminal electrode 76 is in contact with the wire 73, the wire 73 tends to be excessively flattened. As a result, the edge 76*a* of the terminal electrode 76 digs into the wire 73 and breaks the wire 73 in some cases. Otherwise, for example, when the heated chip 77 slightly shifts rightward from the position shown in FIG. 10, an edge 77*a* of the heated chip 77 digs into the wire 73, and as a result, the edge 77*a* breaks the wire 73 in some cases.

Accordingly, the present disclosure provides a coil component having a structure in which a breakage of a wire is unlikely to occur in a thermally pressure-bonding, and a method for manufacturing the coil component.

The coil component according to the present disclosure includes a wire and a terminal electrode to which the wire is connected and which is formed from a metal plate. In the coil component, the terminal electrode has a flat surface to which an end portion of the wire is connected, a low surface that is lower in a thickness direction of the terminal electrode than the flat surface, and a shift surface that connects the flat surface to the low surface and that increases a height in the thickness direction from the low surface to the flat surface.

The wire has a first portion opposing the flat surface, a second portion opposing the shift surface, and a third portion opposing the low surface in order from the end portion thereof. The first portion has a flattened cross-sectional shape and the second portion has a semi-flattened cross-sectional shape that has an amount of flattening decreasing from the first portion toward the third portion.

At the above-described semi-flattened shape of the second portion, it is possible to continuously and gradually change an amount of flattening of the wire. The above phrase, "lower in the thickness direction" means lower in terms of height measured from a surface opposite to a surface to which the end portion of the wire is connected, that is, farther from the wire in the thickness direction of the terminal electrode.

In the coil component according to one embodiment of the present disclosure, the shift surface is preferably a slant surface. According to this configuration, it is possible to reduce the degree of sharpness of an edge at a boundary between the flat surface and the shift surface of the terminal electrode, and thus it is possible to make a breakage of the wire unlikely to occur in a thermally pressure-bonding.

In the coil component according to one embodiment of the present disclosure, the boundary between the shift surface and the flat surface is preferably a rounded shape. According to this configuration, as compared to the above-described case, it is possible to further reduce the degree of sharpness of the edge at the boundary between the flat surface and the shift surface of the terminal electrode, and thus it is possible to further make a breakage of the wire in the thermally pressure-bonding unlikely to occur.

In the coil component according to one embodiment of the present disclosure, the low surface may be a surface on a thin part of the metal plate, or may be a surface on a cranked part of the metal plate.

In the coil component according to one embodiment of the present disclosure, preferably, the terminal electrode further has a second flat surface having the same height as the flat surface, the wire has a fourth portion opposing the second flat surface, the first portion, the second portion, the third portion and the fourth portion in this order from the end portion thereof, and the fourth portion has an original cross-sectional shape of the wire that is not flattened. It is possible to easily obtain the terminal electrode having such a configuration by pressing the metal plate.

Preferably, the coil component according to one embodiment of the present disclosure further includes a core having a winding core portion around which the wire is helically wound and first and second flange portions that are respectively provided at first and second end portions of the winding core portion that are opposite to each other, and the terminal electrode is mounted on each of the first and second flange portions.

In the coil component according to one embodiment of the present disclosure, more preferably, the wire includes first and second wires, the terminal electrode includes first and second terminal electrodes to which first and second end portions of the first wire are connected, respectively, and third and fourth terminal electrodes to which first and second end portions of the second wire are connected, respectively, the first and third terminal electrodes are mounted on the first flange portion, the second and fourth terminal electrodes are mounted on the second flange portion, the first and second wires are wound on the winding core portion in a same direction and form a common mode choke coil.

The method for manufacturing the coil component according to another embodiment of the present disclosure includes preparing a wire and preparing a terminal electrode. The terminal electrode is formed from a metal plate and has a flat surface to which an end portion of the wire is to be connected by a thermally pressure-bonding, a low surface that is lower in a thickness direction of the terminal electrode than the flat surface, and a shift surface that connects the flat surface to the low surface and that increases a height in the thickness direction from the low surface to the flat surface.

The method for manufacturing the coil component according to the embodiment includes placing the end portion of the wire on the flat surface such that the wire is provided sequentially along the flat surface, the shift surface, and the low surface in this order from the end portion thereof.

The method for manufacturing the coil component according to the embodiment further includes thermally pressure-bonding the end portion of the wire to the flat surface by pressing a heated chip opposed the flat surface. In the thermally pressure-bonding, the heated chip is pressed such that an edge thereof overlaps the low surface.

In the placing the end portion of the wire on the flat surface, movement of the end portion of the wire and the flat surface is relative movement, and the case of fixing the flat surface and moving the end portion of the wire to place the end portion of the wire on the flat surface, also the case of fixing the end portion of the wire and moving the flat surface to place the flat surface on the end portion of the wire, and further the case of moving both the end portion of the wire and the flat surface to obtain a state where the end portion of the wire is placed on the flat surface, are included. To press the heated chip opposed the flat surface as described above, the heated chip may be moved, the flat surface may be moved, or both the heated chip and the flat surface may be moved.

The method for manufacturing the coil component according to the embodiment of the present disclosure may further include welding the end portion of the wire and the flat surface after the thermally pressure-bonding.

In the coil component according to one embodiment of the present disclosure, the shift surface and the low surface are provided in the terminal electrode and adjacent to the flat surface to which the end portion of the wire is connected, and the first portion of the wire has a flattened cross-sectional shape but the second portion of the wire has a semi-flattened cross-sectional shape that has an amount of flattening decreasing from the first portion toward the third portion of the wire. Thus, not only at the time of thermally pressure-bonding, but also at the stage of the coil component as a product, it is possible to make a breakage of the wire unlikely to occur.

In the method for manufacturing the coil component according to another embodiment of the present disclosure, in the thermally pressure-bonding, the heated chip is pressed such that the edge thereof overlaps the low surface of the terminal electrode, and thus the portion of the wire that is in contact with the edge of the heated chip deforms along the shift surface and the low surface, so that it is possible to release pressing force applied from the edge of the heated chip. Therefore, it is possible to make a breakage of the wire due to digging of the edge of the heated chip into the wire unlikely to occur.

Other features, elements, characteristics and advantages of the present disclosure will become more apparent from the following detailed description with reference to the attached drawings.

DETAILED DESCRIPTION

Figure 1:
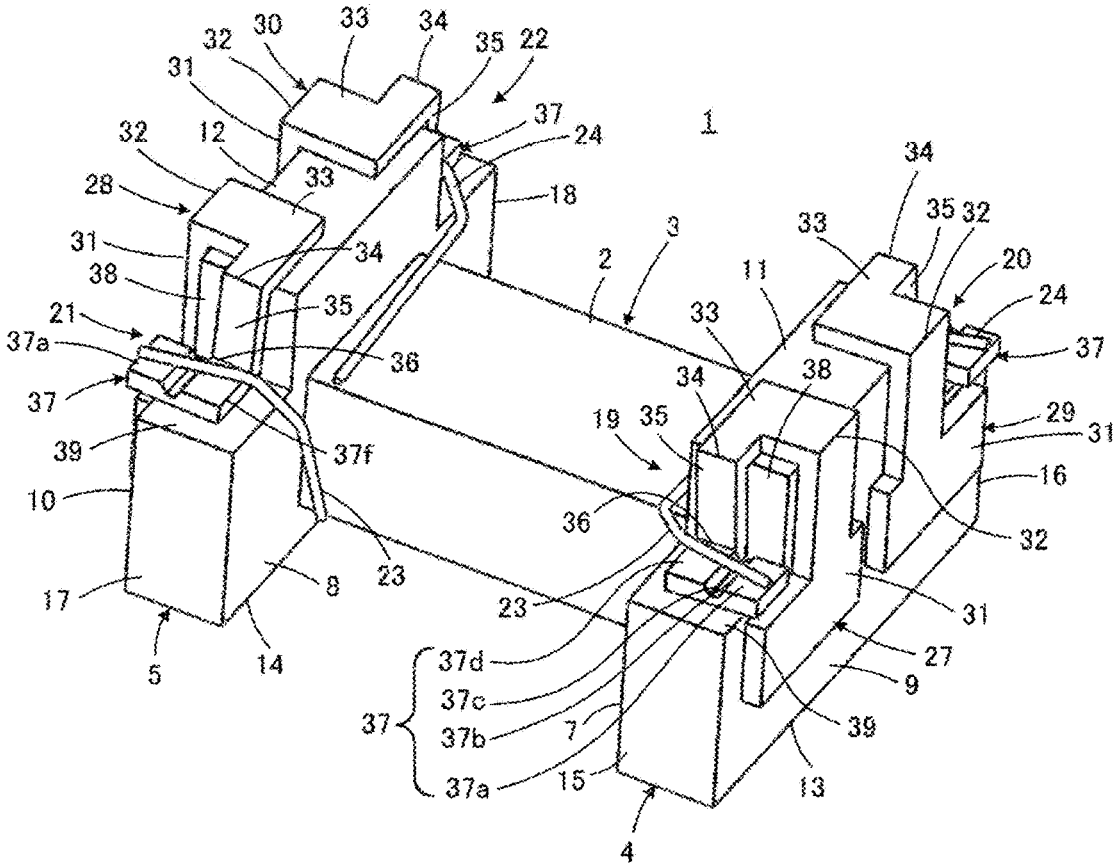
FIG. 1 is a perspective view showing the appearance of a common mode choke coil as a coil component according to a first embodiment of the present disclosure, from a mount surface side.

For describing the coil component according to some embodiments of the present disclosure, a common mode choke coil is taken as an example of the coil component. A common mode choke coil 1 will be described as a coil component according to a first embodiment of the present disclosure mainly with reference to FIG. 1.

The common mode choke coil 1 includes a substantially drum-shaped core 3 having a winding core portion 2. The drum-shaped core 3 includes first and second flange portions 4 and 5 respectively provided at first and second end portions of the winding core portion 2 that are opposite to each other. Although not shown, the common mode choke coil 1 may further include a substantially plate-shaped core extending between the first and second flange portions 4 and 5. The drum-shaped core 3 and the plate-shaped core are preferably formed from ferrite, but may be formed from a material other than ferrite.

In the case where the drum-shaped core 3 is formed from ferrite, the drum-shaped core 3 has a Curie temperature of about 150° C. or higher. This is because, from low temperatures to about 150° C., it is possible to maintain an inductance value at a certain value or higher. The relative permeability of the drum-shaped core 3 is preferably not greater than about 1500. According to this configuration, it is not necessary to use a special one for high permeability for the configuration or material of the drum-shaped core 3. Therefore, the flexibility in designing the drum-shaped core 3 improves, and it is possible to easily design the drum-shaped core 3 having a Curie temperature of about 150° C. or higher, for example. As described above, according to the above configuration, it is possible to provide the common mode choke coil 1 having an inductance value ensured at high temperatures and having favorable temperature characteristics.

Also regarding the above-described plate-shaped core that is not shown, in the case where the plate-shaped core is formed from ferrite, the plate-shaped core preferably has a Curie temperature of about 150° C. or higher and preferably has a relative permeability of about 1500 or less.

The flange portions 4 and 5 respectively have inner end surfaces 7 and 8 that face the winding core portion 2 side and on which the respective end portions of the winding core portion 2 are located, and outer end surfaces 9 and 10 that face the outer side opposite to the inner end surfaces 7 and 8. In addition, the flange portions 4 and 5 respectively have bottom surfaces 11 and 12 that face the mount substrate (not shown) side at the time of mounting, and top surfaces 13 and 14 opposite to the bottom surfaces 11 and 12. The above-described plate-shaped core that is not shown is jointed to the top surfaces 13 and 14 of the flange portions 4 and 5. Furthermore, the first flange portion 4 has first and second side surfaces 15 and 16 that extend in a direction in which the bottom surface 11 and the top surface 13 are connected to each other and that face lateral sides opposite to each other, and the second flange portion 5 has first and second side surfaces 17 and 18 that extend in a direction in which the bottom surface 12 and the top surface 14 are connected to each other and that face the lateral sides opposite to each other.

Cutout-like recesses 19 and 20 are provided at both end portions of the bottom surface 11 of the first flange portion 4. Similarly, cutout-like recesses 21 and 22 are provided at both end portions of the bottom surface 12 of the second flange portion 5.

The common mode choke coil 1 further includes first and second wires 23 and 24 that are helically wound on the winding core portion 2. In FIG. 1, only end portions of the respective wires 23 and 24 are shown, and the wires 23 and 24 on the winding core portion 2 are not shown. Also in FIGS. 2, 3, and 9, the wires 23 and 24 on the winding core portion 2 are not shown. These wires 23 and 24 are not specifically shown, and each have a linear central conductor and an insulating coating layer that coats the peripheral surface of the central conductor.

The central conductor is formed from a copper wire, for example. The insulating coating layer is preferably formed from a resin having at least an imide bond such as polyamide-imide and imide-modified polyurethane. According to this configuration, it is possible to impart, to the insulating coating layer, heat resistance that prevents decomposition even at 150° C. Therefore, even at a high temperature such as 150° C., the inter-line capacitance does not change, and it is possible to make the Sdd11 characteristics favorable. In addition, it is possible to enhance the effectiveness of an effect such as noise control effect being excellent even at a high temperature such as 150° C.

The first and second wires 23 and 24 are wound in the same direction while being parallel to each other. At this time, the wires 23 and 24 may be wound in a two-layer winding manner in which either one wire is at the inner layer side and the other wire is at the outer layer side, or may be wound in a bifilar winding manner in which the wires 23 and 24 are alternately arranged in the axial direction of the winding core portion 2 and parallel to each other.

The central conductor preferably has a diameter of about 35 μm or smaller. According to this configuration, it is possible to decrease the diameters of the wires 23 and 24, and thus it is possible to increase the numbers of turns of the wires 23 and 24 on the winding core portion 2, achieve size reduction without changing the numbers of turns of the wires 23 and 24, and increase the wire interval without changing the wires 23 and 24 or the coil outer shape, for example. In addition, by decreasing the proportion of the wires 23 and 24 in the coil outer shape, it is possible to increase the dimensions of the other portions such as the drum-shaped core 3, and thus it is possible to further improve the characteristics.

The central conductor preferably has a diameter of about 28 μm or larger. According to this configuration, it is possible to make a breakage of the central conductor unlikely to occur.

The insulating coating layer preferably has a thickness dimension of about 6 μm or smaller. According to this configuration, it is possible to decrease the diameters of the wires 23 and 24, and thus it is possible to increase the numbers of turns of the wires 23 and 24 on the winding core portion 2, achieve size reduction without changing the numbers of turns of the wires 23 and 24, and increase the wire interval without changing the wires 23 and 24 or the coil outer shape, for example. In addition, by decreasing the proportion of the wires 23 and 24 in the coil outer shape, it is possible to increase the dimensions of the other portions such as the drum-shaped core 3, and thus it is possible to further improve the characteristics.

The insulating coating layer preferably has a thickness dimension of about 3 μm or larger. According to this configuration, it is possible to increase the distance between the central conductors of the wires 23 and 24 adjacent to each other in the wound state, and thus the inter-line capacitance decreases, so that it is possible to make the Sdd11 characteristics favorable.

The common mode choke coil 1 further includes first to fourth terminal electrodes 27 to 30. Among these first to fourth terminal electrodes 27 to 30, the first and third terminal electrodes 27 and 29 are arranged in the direction in which the first and second side surfaces 15 and 16 oppose each other in the first flange portion 4, and are mounted on the first flange portion 4 via an adhesive. The second and fourth terminal electrodes 28 and 30 are arranged in the direction in which the first and second side surfaces 17 and 18 oppose each other in the second flange portion 5, and are mounted on the second flange portion 5 via an adhesive.

A first end of the first wire 23 is electrically connected to the first terminal electrode 27, and a second end of the first wire 23 opposite to the first end is electrically connected to the second terminal electrode 28. A first end of the second wire 24 is electrically connected to the third terminal electrode 29, and a second end of the second wire 24 opposite to the first end is electrically connected to the fourth terminal electrode 30.

The first terminal electrode 27 and the fourth terminal electrode 30 have the same shape, and the second terminal electrode 28 and the third terminal electrode 29 have the same shape. In addition, the first terminal electrode 27 and the third terminal electrode 29 have shapes that are plane-symmetrical to each other, and the second terminal electrode 28 and the fourth terminal electrode 30 have shapes that are plane-symmetrical to each other. Therefore, among the first to fourth terminal electrodes 27 to 30, one terminal electrode, for example, the first terminal electrode 27, which is illustrated in FIG. 1 in the most favorable manner and illustrated in FIGS. 2 and 3, will be described in detail, and the detailed description of the second, third, and fourth terminal electrodes 28, 29, and 30 is omitted.

The terminal electrode 27 is normally produced by performing progressive press on one metal plate formed from a copper-based alloy such as phosphor bronze or touch pitch copper. The metal plate that is the material of the terminal electrode 27 has a thickness of about 0.15 mm or smaller, and has a thickness of about 0.1 mm, for example.

The terminal electrode 27 includes: a base portion 31 that extends along the outer end surface 9 of the flange portion 4; and a mount portion 33 that extends along the bottom surface 11 of the flange portion 4 from the base portion 31 via a first bent portion 32 covering a ridge portion at which the outer end surface 9 and the bottom surface 11 of the flange portion 4 intersect each other. When the common mode choke coil 1 is mounted on a mount substrate that is not shown, the mount portion 33 becomes a portion electrically and mechanically connected to a conductive land on the mount substrate by means of soldering or the like.

The terminal electrode 27 further includes: a rising portion 35 that extends from the mount portion 33 via a second bent portion 34; and a connection portion 37 that extends from the rising portion 35 via a third bent portion 36. The rising portion 35 extends along a perpendicular wall 38 that defines the recess 19, and the connection portion 37 extends along a bottom surface wall 39 that defines the recess 19. The connection portion 37 is a portion that extends along the end portion of the wire 23 and that electrically and mechanically connects the wire 23 to the terminal electrode 27.

Figure 2:
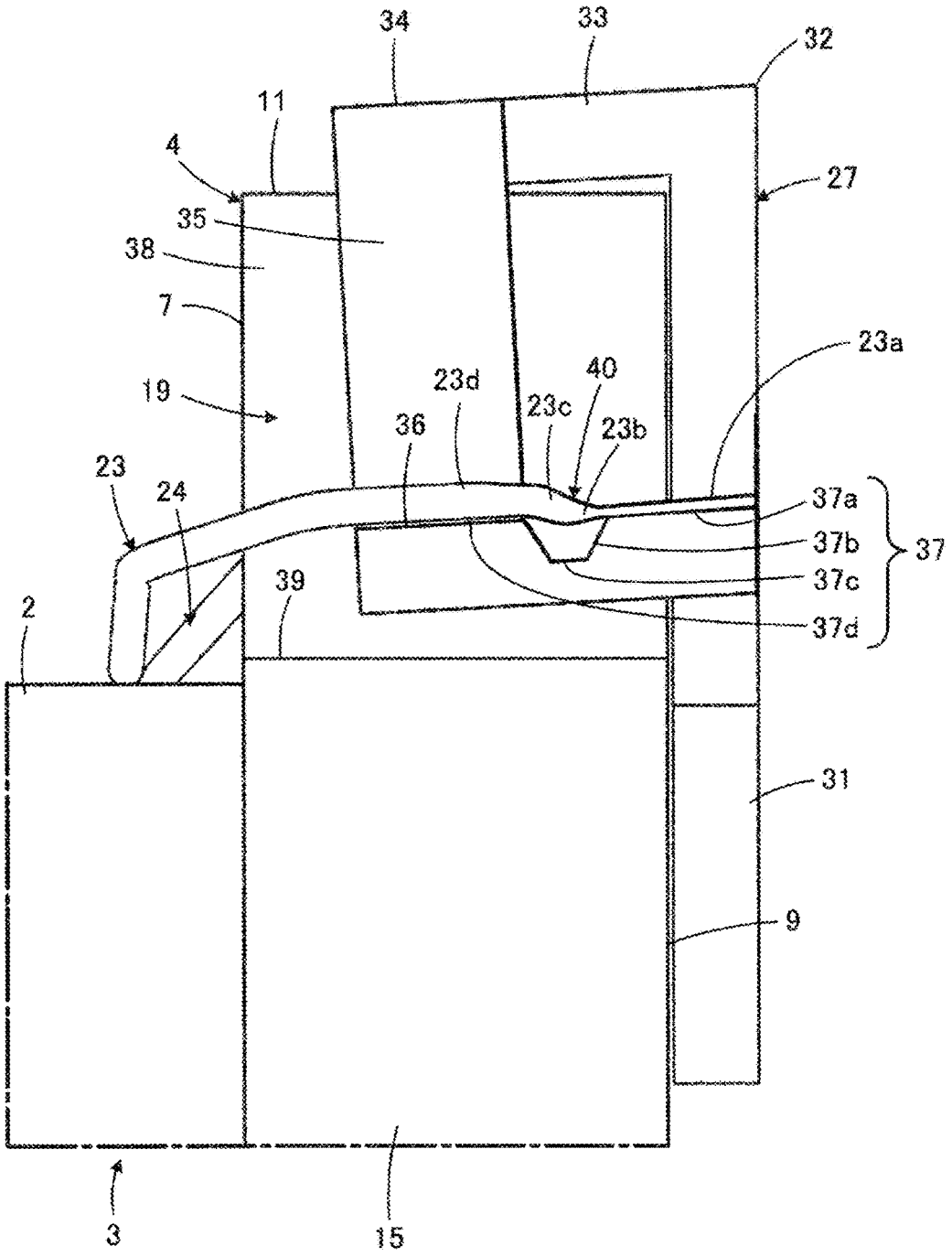
FIG. 2 is a front view showing, in an enlarged manner, the configuration at a first flange portion side that is a part of the common mode choke coil shown in FIG. 1 and included in a substantially drum-shaped core.

More specifically, as shown in FIG. 2, the connection portion 37 of the terminal electrode 27 has a flat surface 37*a* to which the end portion of the wire 23 is connected by a thermally pressure-bonding; a low surface 37*c* that is lower in a thickness direction of the terminal electrode 27 than the flat surface 37*a*; and a shift surface 37*b* that connects the flat surface 37*a* to the low surface 37*c* and that increases the height in the thickness direction of the terminal electrode 27 from the low surface 37*c* to the flat surface 37*a*. In this embodiment, the shift surface 37*b* is a slant surface and has a dimension that can be measured in the longitudinal direction of the wire 23. The connection portion 37 of the terminal electrode 27 further has a second flat surface 37*d* having the same height as the flat surface 37*a*. The second flat surface 37*d* is located at a position following the flat surface 37*a*, the shift surface 37*b*, and the low surface 37*c* in the longitudinal direction of the wire 23.

In the illustrated embodiment, a slant surface is also formed between the low surface 37*c* and the second flat surface 37*d* but is not an essential feature. That is, a slant surface may not be formed therebetween, and the low surface 37*c* is connected to the second flat surface 37*d* via a surface extending perpendicularly upward from the low surface 37*c*. The flat surface 37*a*, the shift surface 37*b*, the low surface 37*c*, and the second flat surface 37*d* described above are more clearly understandable when referring to FIG. 4 in which these surfaces are schematically shown so as to be enlarged in the longitudinal direction of the wire 23.

Figure 4:
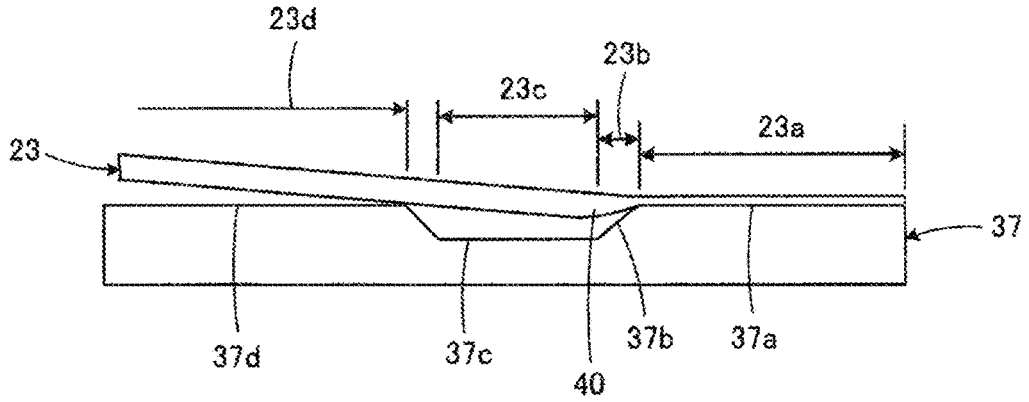
FIG. 4 illustrates the relationship between a terminal electrode and a wire shown in FIG. 2 and is a diagram schematically showing, in an enlarged manner, a dimension appearing in the length direction of the wire.

With reference to FIGS. 2 and 4, the wire 23 has a first portion 23*a* opposing the flat surface 37*a*, a second portion 23*b* opposing the shift surface 37*b*, a third portion 23*c* opposing the low surface 37*c*, and a fourth portion 23*d* opposing the second flat surface 37*d* in order from the end portion thereof. The first portion 23*a* has a cross-sectional shape flattened in a thermally pressure-bonding direction and the second portion 23*b* has a semi-flattened cross-sectional shape that has an amount of flattening decreasing from the first portion 23*a* toward the third portion 23*c*. That is, the second portion 23*b* becomes a semi-flattened portion 40 that changes from the cross-sectional shape flattened in the thermally pressure-bonding direction to the original cross-sectional shape. In the semi-flattened portion 40, it is possible to continuously and gradually change the amount of flattening of the wire 23. The fourth portion 23*d* has the original cross-sectional shape of the wire 23, which is not flattened.

Reference characters 31, 32, 33, 34, 35, 36, 37, 37*a*, 37*b*, 37*c*, and 37*d*, which are used for designating the base portion, the first bent portion, the mount portion, the second bent portion, the rising portion, the third bent portion, the connection portion, the flat surface, the shift surface, the low surface, and the second flat surface of the above described first terminal electrode 27, respectively, are also used for designating the corresponding portions of the second, third, and fourth terminal electrodes 28, 29, and 30 as necessary.

Normally, a step of winding the wires 23 and 24 on the winding core portion 2 is performed before a connecting step of connecting the above-described wires 23 and 24 and the terminal electrodes 27 to 30 is performed. In the winding step, in a state where the drum-shaped core 3 is rotated about the central axis of the winding core portion 2, the wires 23 and 24 are fed from a nozzle toward the winding core portion 2 while being traversed. Accordingly, the wires 23 and 24 are helically wound on the winding core portion 2.

In the winding step, in order to rotate the drum-shaped core 3 as described above, the drum-shaped core 3 is held by a chuck connected to a rotation drive source. The chuck is designed to hold one of the flange portions of the drum-shaped core 3, for example, the first flange portion 4.

The number of turns of each of the first and second wires 23 and 24 on the winding core portion 2 is preferably not greater than 42 turns. This is because it is possible to shorten the total length of the wires 23 and 24, and thus it is possible to make the Sdd11 characteristics more favorable. In order to ensure an inductance value, the number of turns of each of the wires 23 and 24 is preferably not less than 39 turns.

After the end of the winding step, the later-described connecting step of connecting the wires 23 and 24 and the terminal electrodes 27 to 30 is performed.

Hereinafter, a step of connecting the first wire 23 to the first terminal electrode 27 will be described as a representative.

After the end of the above-described winding step, the end portion of the wire 23 is extended onto the flat surface 37*a* of the connection portion 37. In this state, the wire 23 is provided sequentially along the flat surface 37*a*, the shift surface 37*b*, the low surface 37*c*, and the second flat surface 37*d* in this order from the end portion of the wire 23 placed on the flat surface 37*a*.

Figure 3:
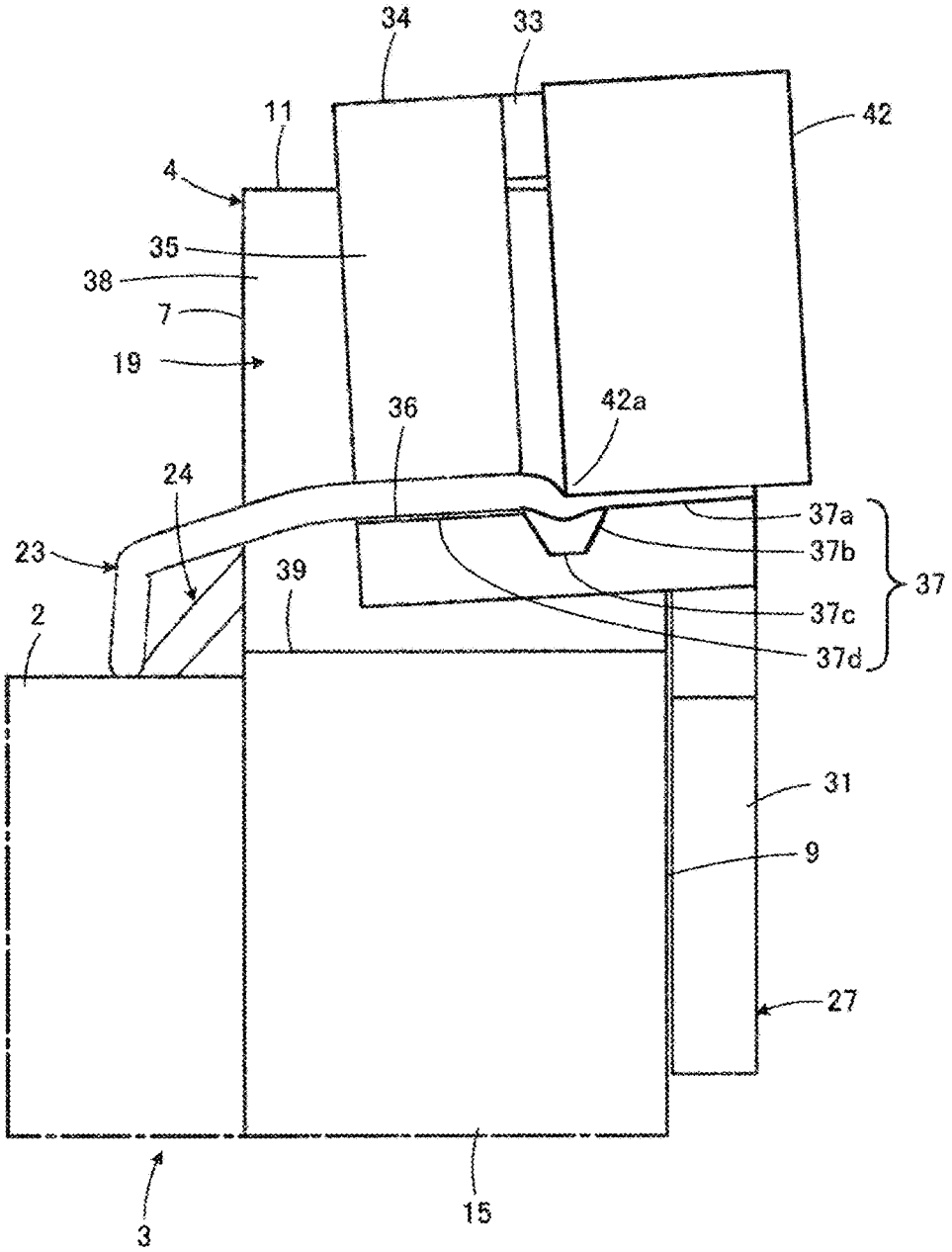
FIG. 3 is a diagram corresponding to FIG. 2 and shows a state where a thermally pressure-bonding step is being performed.

Next, as shown in FIG. 3, a thermally pressure-bonding the end portion of the wire 23 to the flat surface 37*a* is performed by the heated chip 42 opposed the flat surface 37*a*. The heated chip 42 is placed so as to oppose the flat surface 37*a* with the wire 23 interposed therebetween, and the heated chip 42 is pressed toward the flat surface 37*a* in this state. In the thermally pressure-bonding, the heated chip 42 is pressed such that an edge 42*a* thereof overlaps the low surface 37*c*.

Since the heated chip 42 is pressed as described above, a portion of the wire 23 that is in contact with the edge 42*a* of the heated chip 42 deforms along the shift surface 37*b* and the low surface 37*c*, so that it is possible to release pressing force applied from the edge 42*a* of the heated chip 42. Therefore, it is possible to make a breakage of the wire 23 due to digging of the edge 42*a* of the heated chip 42 into the wire 23 unlikely to occur.

In addition, the shift surface 37*b* is a slant surface to contribute to making a breakage of the wire 23 unlikely to occur. This is because the slant surface is able to reduce the degree of sharpness of the edge at the boundary between the flat surface 37*a* and the shift surface 37*b*. The insulating coating layer of the wire 23 may be removed, for example, by laser irradiation prior to the above-described thermally pressure-bonding, or may be removed by heating with the heated chip 42 simultaneously with the thermally pressure-bonding step.

When the above-described thermally pressure-bonding step is ended, the first portion 23*a* of the wire 23 that opposes the flat surface 37*a* has a cross-sectional shape flattened in the thermally pressure-bonding direction as described above, and the second portion 23*b* of the wire 23 opposing the shift surface 37*b* has the semi-flattened cross-sectional shape that has an amount of flattening decreasing from the first portion 23*a*, which opposes the flat surface 37*a*, toward the third portion 23*c*, which opposes the low surface 37*c*. That is, the second portion 23*b* becomes a semi-flattened portion 40 that changes from the cross-sectional shape flattened in the thermally pressure-bonding direction to the original cross-sectional shape. The fourth portion 23*d* of the wire 23 that opposes the second flat surface 37*d* has the original cross-sectional shape which is not flattened.

Figure 5:
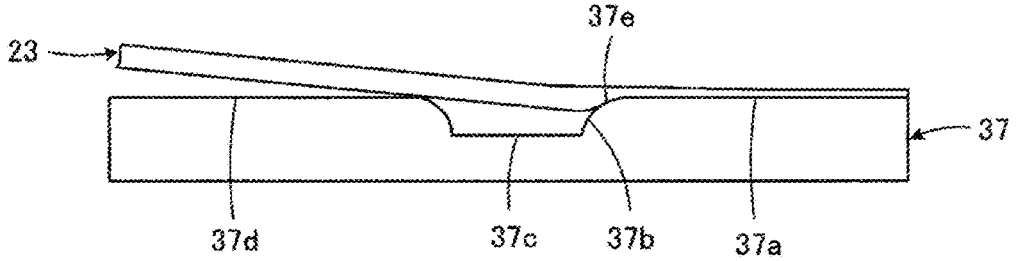
FIG. 5 illustrates a second embodiment of the present disclosure and is a diagram corresponding to FIG. 4.
Figure 6:
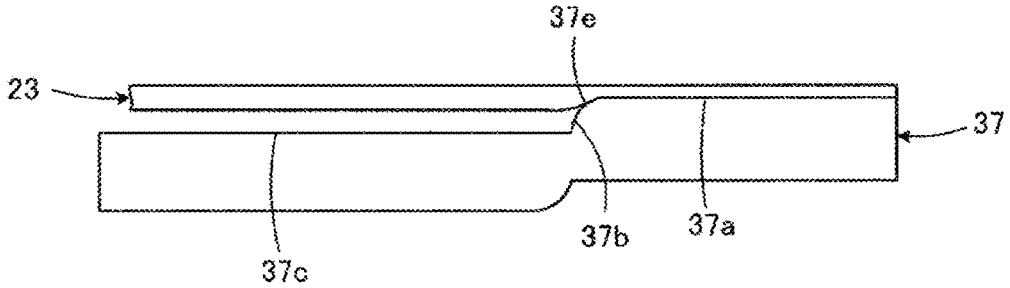
FIG. 6 illustrates a third embodiment of the present disclosure and is a diagram corresponding to FIG. 4.

FIGS. 5 and 6 illustrate second and third embodiments of the present disclosure, respectively, and are diagrams corresponding to FIG. 4. In FIGS. 5 and 6, elements corresponding to the elements shown in FIG. 4 are designated by the same reference characters, and the overlap description is omitted.

With reference to FIG. 5, the boundary between the shift surface 37*b* and the flat surface 37*a* is a rounded shape and becomes a round surface 37*e*. The round surface 37*e* is able to reduce the degree of sharpness of the edge at the boundary between the flat surface 37*a* and the shift surface 37*b*, thereby making a breakage of the wire 23 unlikely to occur in the thermal pressure bonding step. In the embodiment shown in FIG. 5, a round surface is also formed between the low surface 37*c* and the second flat surface 37*d* but is not an essential feature.

In the embodiments shown in FIGS. 4 and 5, respectively, the low surface 37*c* is a surface on a thin part of the metal plate forming the terminal electrode 27 by means of stamping or the like. However, as shown in FIG. 6, the low surface 37*c* may be a surface on a cranked part of the metal plate forming the terminal electrode 27. Also in the terminal electrode 27 shown in FIG. 6, a round surface 37*e* is formed at the boundary between the shift surface 37*b* and the flat surface 37*a*.

Figure 7:
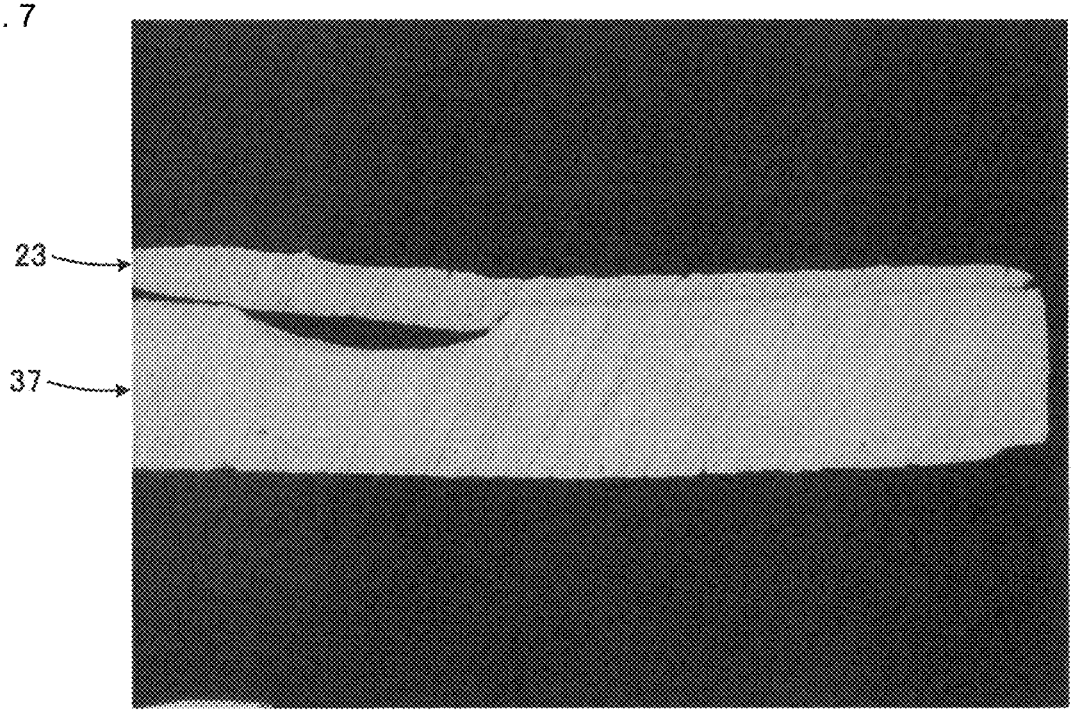
FIG. 7 is a diagram showing a picture obtained by photographing a cross-section of a sample appearing by polishing a portion of a wire that is thermally pressure-bonded to a connection portion of a terminal electrode.

FIG. 7 shows a picture obtained by photographing a cross-section of a sample appearing by polishing the portion of the wire 23 that is thermally pressure-bonded to the connection portion 37 of the terminal electrode 27. From FIG. 7, the following state is confirmed. That is, the wire 23 has, at the connection portion 37 of the terminal electrode 27 in order from the end portion thereof, the first portion opposing the flat surface, the second portion opposing the shift surface, the third portion opposing the low surface, and the fourth portion opposing the second flat surface. The wire 23 has, at the first portion, a cross-sectional shape flattened in the thermally pressure-bonding direction, the second portion has a semi-flattened cross-sectional shape that has an amount of flattening decreasing from the first portion toward the third portion. In addition, in FIG. 7, the fourth portion of the wire 23 has the original cross-sectional shape of the wire 23, which is not flattened.

In addition, a layer that appears blackish is formed along the interface between the flat surface and the first portion of the wire 23. This layer is inferred to be formed due to mutual diffusion of copper forming the central conductor of the wire and tin forming a plating film provided on the terminal electrode.

The connection between the first terminal electrode 27 and the first wire 23 has been described above. However, regarding the connection between the other terminal electrodes 28 to 30 and the wire 23 or 24, the same connecting step is performed and the same connection structure is achieved.

Figure 8:
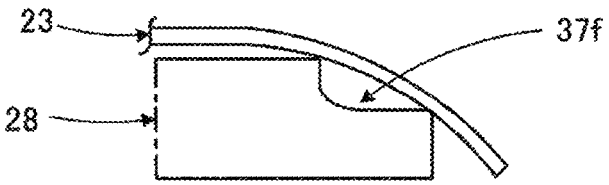
FIG. 8 illustrates a fourth embodiment of the present disclosure and is a diagram showing a wire and an end portion opposite to a flat surface of a terminal electrode.

FIG. 8 illustrates a fourth embodiment of the present disclosure and is a diagram showing the end portion of the wire 23 that is opposite to the flat surface 37*a* of the second terminal electrode 28.

As is seen from FIG. 1, the first and fourth terminal electrodes 27 and 30 are respectively located at the sides opposite to the sides at which the first and second wires 23 and 24 are extended from the winding core portion 2. The second and third terminal electrodes 28 and 29 are respectively located at the sides at which the first and second wires 23 and 24 are extended from the winding core portion 2. Thus, the first and second wires 23 and 24 connected to the second and third terminal electrodes 28 and 29 may come into contact with an edge portion 37*f* of the end portion of the connection portion 37 that is opposite to the flat surface 37*a*. As a result, the wires 23 and 24 may be broken or damaged by the insulating coating layer 26.

In order to make the above damage or breakage unlikely to occur, in the embodiment shown in FIG. 8, the above edge portion 37*f* is chamfered. Since the edge portion 37*f* is chamfered as described above, even when the wire 23 comes into contact with the terminal electrode 28, a load applied from the terminal electrode 28 to the wire 23 is distributed by increasing the area of contact therebetween or providing multiple locations of contact therebetween. Therefore, it is possible to make the above breakage or damage of the wire 23 by the insulating coating layer unlikely to occur. The edge portion 37*f* of the terminal electrode 28 shown in FIG. 8 is chamfered such that a recess-like round surface is formed thereon, but many modifications may be made for a shape provided as a result of chamfering.

Figure 9:
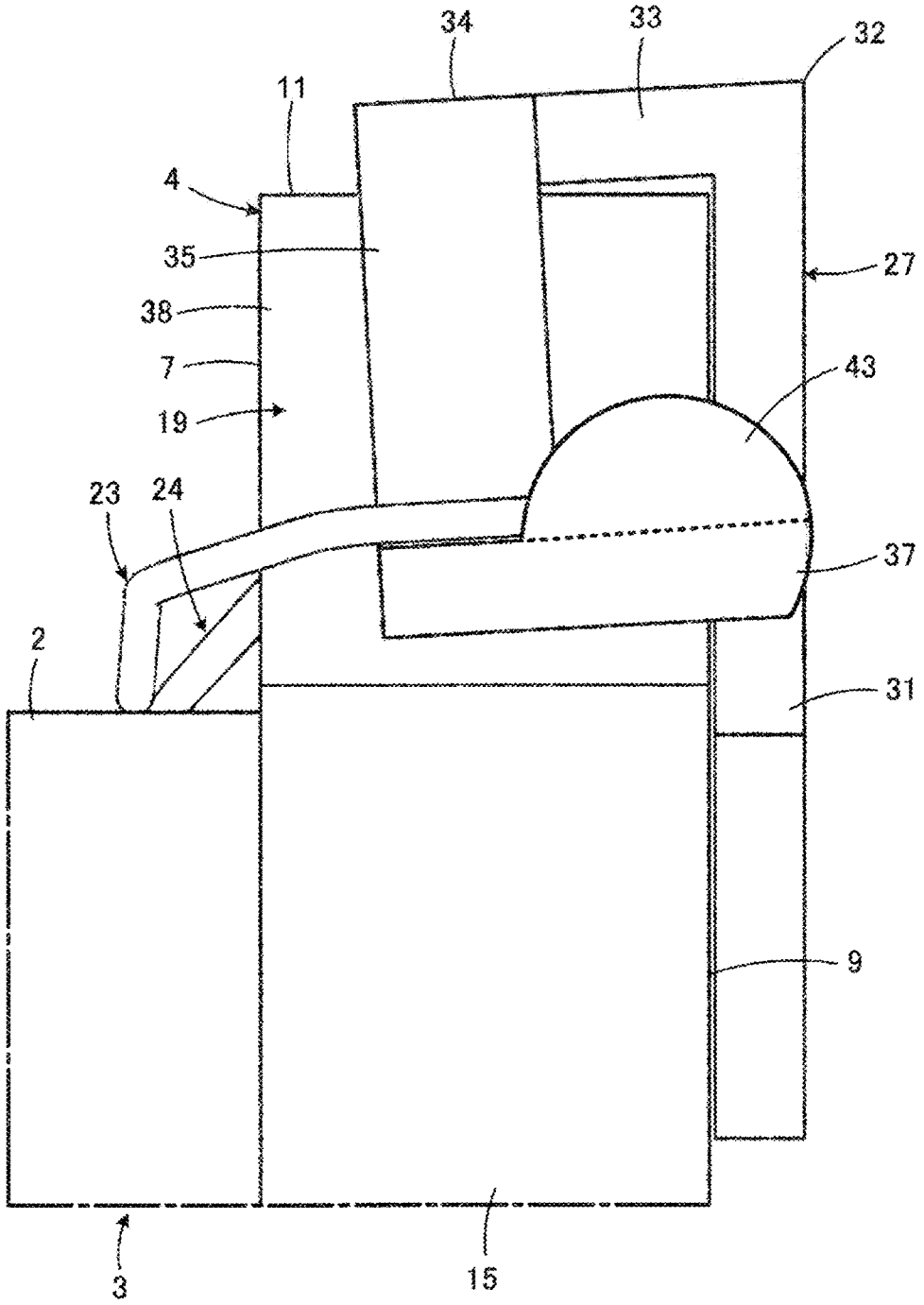
FIG. 9 illustrates a fifth embodiment of the present disclosure, is a diagram corresponding to FIG. 2, and shows a state after a wire and a terminal electrode are welded to each other.
Figure 10:
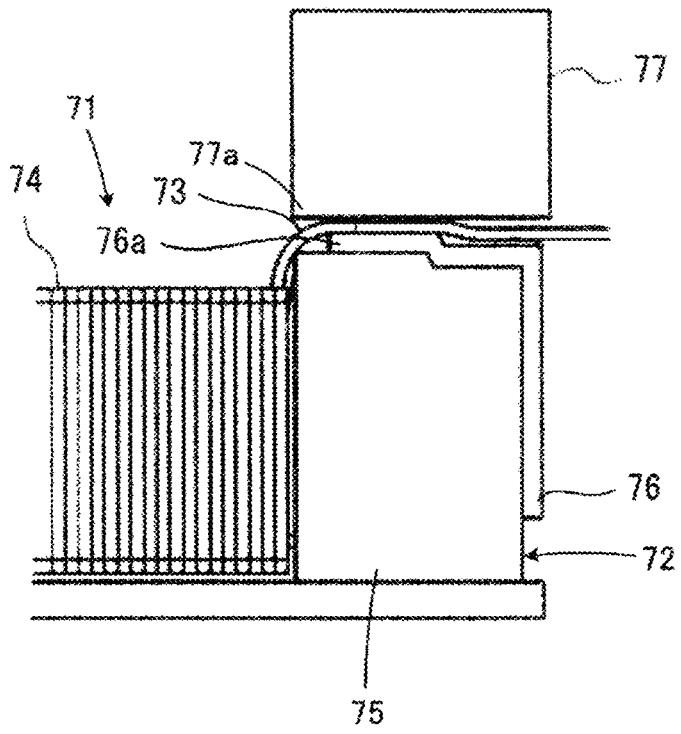
FIG. 10 is a front view showing one flange portion that is a part of a substantially drum-shaped core included in a coil component and a terminal electrode disposed at the flange portion, and illustrates a step of thermally pressure-bonding the wire to the terminal electrode.

FIG. 9 illustrates a fifth embodiment of the present disclosure and is a diagram corresponding to FIG. 2. In FIG. 9, elements corresponding to the elements shown in FIG. 2 are designated by the same reference characters, and the overlap description is omitted.

The fifth embodiment is characterized in that a welding is performed after the above-described thermally pressure-bonding. In the welding, laser welding is preferably used. Laser light for welding is applied so as to cover a region from the flat surface 37*a* to the low surface 37*c* of the connection portion 37, including the thermally pressure-bonded portion of the wire 23. Accordingly, the central conductor of the wire 23 and the region from the flat surface 37*a* to the low surface 37*c* of the connection portion 37, the region being irradiated with the laser light, are melted. At this time, the melted portion is made into a substantially ball shape due to the surface tension applied thereto, whereby a weld block portion 43 is formed. That is, the weld block portion 43 is formed by integrating the central conductor of the wire 23 and a part of the terminal electrode 27, and the wire 23 is incorporated into the weld block portion 43.

In a state after the above-described welding, the original cross-sectional shape of the wire 23 is preferably maintained to a portion connected to the weld block portion 43.

Preferably, the connection portion 37 is located at a predetermined interval from the flange portion 4 such that the connection portion 37 is not in contact with the flange portion 4. According to this configuration, in the above-described welding step, temperature rise in the connection portion 37 is unlikely to be transmitted to the flange portion 4 side, and thus it is possible to reduce an adverse effect of heat on the drum-shaped core 3.

When welding is used in addition to thermal pressure bonding for connecting the wire 23 and the terminal electrode 27 as described above, a firmer connection state is achieved. Thus, higher mechanical strength, lower electric resistance, higher stress resistance, higher chemical erosion resistance, and the like are obtained, and thus higher reliability of the connection structure is achieved.

In the above embodiments, in welding the terminal electrode and the wire, laser welding is used, but the present disclosure is not limited thereto, and arc welding or the like may be used.

The same connection as the above-described connection between the first terminal electrode 27 and the first wire 23 is applied to the connection between the other terminal electrodes 28 to 30 and the wire 23 or 24.

The coil component according to the present disclosure has been described based on the embodiments regarding more specific common mode choke coils, but these embodiments are illustrative, and other various modifications may be made.

For example, the number of wires included in the coil component, the direction in which each wire is wound, the number of terminal electrodes, and the like may be changed in accordance with the function of the coil component.

The coil component according to the present disclosure may be a coil component that does not include a core.

It should be noted that each embodiment described in the present specification is illustrative, and the components in the different embodiments may be partially replaced or combined.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A method for manufacturing a coil component, the method comprising:

preparing at least one wire having a first end portion and a second end portion;

preparing a core having a winding core portion and first and second flange portions that are respectively provided at first and second end portions of the winding core portion that are opposite to each other;

helically winding the at least one wire around the winding core portion;

forming first and second terminal electrodes from first and second metal plates, respectively;

wherein the first metal plate has a first flat surface, a first low surface, and a first shift surface, the second metal plate has a second flat surface, a second low surface, and a second shift surface, the first low surface is lower in a first thickness direction of the first terminal electrode than the first flat surface, the second low surface is lower in a second thickness direction of the second terminal electrode than the second flat surface, the first shift surface connects the first flat surface to the first low surface and increases a first height in the first thickness direction from the first low surface to the first flat surface, and the second shift surface connects the second flat surface to the second low surface and increases a second height in the second thickness direction from the second low surface to the second flat surface;

mounting the first terminal electrode and the second terminal electrode on the first flange portion and the second flange portion, respectively;

placing the first and second end portions of the least one wire on the first and second flat surfaces, respectively, such that the at least one wire is provided sequentially along the first and second flat surfaces, the first and second shift surfaces, and the first and second low surfaces in this order from the first and second end portions, respectively; and thermally pressure-bonding the first and second end portions of the at least one wire to the first and second flat surfaces, respectively, the thermally pressure-bonding includes heating a chip and pressing the heated chip opposed the first and second flat surfaces, such that in the thermally pressure-bonding, the heated chip is pressed so that an edge thereof overlaps the first and second low surfaces, respectively.

2. The method for manufacturing the coil component according to claim 1, further comprising:

welding the first and second end portions of the at least one wire and the first and second flat surfaces, respectively, after the thermally pressure-bonding.

3. The method for manufacturing the coil component according to claim 1, wherein the first and second shift surfaces include first and second slant surfaces, respectively.

4. The method for manufacturing the coil component according to claim 1, including:

forming a first boundary with a first round shape between the first shift surface and the first flat surface, and a second boundary with a second round shape between the second shift surface and the second flat surface.

5. The method for manufacturing the coil component according to claim 1, wherein the first low surface is a first surface on a first thin part of the first metal plate, and the second low surface is a second surface on a second thin part of the second metal plate.

6. The method for manufacturing the coil component according to claim 1, wherein the first low surface is a first surface on a first cranked part of the first metal plate, and the second low surface is a second surface on a second cranked part of the second metal plate.

7. The method for manufacturing the coil component according to claim 1, wherein the first terminal electrode and second terminal electrode further include a third flat surface and a fourth flat surface, respectively, the third flat surface has a same first height as the first flat surface, and the fourth flat surface has a same second height as the second flat surface, the preparing the at least one wire includes preparing the at least one wire to have a first portion opposing the first flat surface, a second portion opposing the second flat surface, a third portion opposing the first shift surface, a fourth portion opposing the second shift surface, a fifth portion opposing the first low surface, a sixth portion opposing the second low surface, a seventh portion opposing the third flat surface, and an eighth portion opposing the fourth flat surface, the first portion, the third portion, the fifth portion, and the seventh portion are in this first order from the first end portion of the at least one wire, the second portion, the fourth portion, the sixth portion, and the eighth portion are in this second order from the second end portion of the at least one wire, the seventh portion has a first original cross-sectional shape of the at least one wire that is not flattened, and the eighth portion has a second original cross-sectional shape of the at least one wire that is not flattened.

8. The method for manufacturing the coil component according to claim 1, wherein:

the preparing the at least one wire includes preparing first and second wires, wherein the first wire includes the first and second end portions, and the second wire includes third and fourth end portions;

the helically winding includes winding the first and second wires on the winding core portion in a same direction to form a common mode choke coil;

the forming the first and second terminal electrodes further includes preparing third and fourth terminal electrodes; and the placing and the thermally-pressure bonding connect the first and second end portions of the first wire to the first and second terminal electrodes, respectively.

9. The method for manufacturing the coil component according to claim 8, further comprising:

connecting the third and fourth end portions of the second wire to the third and fourth terminal electrodes, respectively;

mounting the third terminal electrode on the first flange portion; and mounting the fourth terminal electrode on the second flange portion.

* * * * *